United States Patent [19]

Brooks et al.

[11] Patent Number: 4,926,923

[45] Date of Patent: May 22, 1990

[54] DEPOSITION OF METALLIC PRODUCTS USING RELATIVELY COLD SOLID PARTICLES

[75] Inventors: Reginald G. Brooks; Alan Leatham; Jeffrey Coombs, all of Swansea, Wales

[73] Assignee: Osprey Metals Ltd., Wales

[21] Appl. No.: 842,943

[22] Filed: Mar. 24, 1986

[30] Foreign Application Priority Data

Mar. 25, 1985 [GB] United Kingdom ..... 8507647

[51] Int. Cl.[5] ..... B22D 23/00

[52] U.S. Cl. ..... 164/5; 164/46; 164/97; 164/122

[58] Field of Search ..... 164/46, 97, 122, 133, 164/900, 5

[56] References Cited

U.S. PATENT DOCUMENTS

| | | | |
|---|---|---|---|
| 3,826,301 | 7/1974 | Brooks | 164/46 |
| 3,909,921 | 10/1975 | Brooks | 164/46 X |
| 4,066,117 | 1/1978 | Clark et al. | 164/46 |
| 4,114,251 | 9/1978 | Southern et al. | 164/46 X |
| 4,420,031 | 12/1983 | Frykendahl | 164/133 X |
| 4,512,384 | 4/1985 | Sendzimir | 164/46 |
| 4,592,404 | 6/1986 | Sendzimir | 164/46 |

FOREIGN PATENT DOCUMENTS

| | | |
|---|---|---|
| 0127303 | 12/1984 | European Pat. Off. . |
| 58-86969 | 5/1983 | Japan . |
| 58-218359 | 12/1983 | Japan . |
| 82/03809 | 11/1982 | PCT Int'l Appl. . |
| 399297 | 2/1974 | U.S.S.R. . |
| 809412 | 2/1959 | United Kingdom . |
| 1262471 | 2/1972 | United Kingdom . |
| 1455862 | 11/1976 | United Kingdom . |
| 1472939 | 5/1977 | United Kingdom . |
| 1574711 | 9/1980 | United Kingdom . |
| 2115014B | 9/1983 | United Kingdom . |

*Primary Examiner*—Nicholas P. Godici
*Assistant Examiner*—J. Reed Batten, Jr.
*Attorney, Agent, or Firm*—Roylance, Abrams, Berdo & Goodman

[57] ABSTRACT

A stream of molten metal is atomized to form a spray and additional cooling is provided by applying to the stream or spray relatively cold solid particles. The solid particles are preferably injected into the spray and may be formed from overspray particles recycled from the deposition process.

7 Claims, 5 Drawing Sheets

DEPOSITION OF METALLIC PRODUCTS USING RELATIVELY COLD SOLID PARTICLES

This invention relates to an improved method of producing rapidly solidified metallic products by atomization and subsequent deposition onto a collector of a stream of molten metal or metal alloy. The spray products may be coherent spray deposits, hot or cold worked spray deposits; or thixocast, thixoforged, thixoextruded or thixoworked spray deposits. The products may be in the form of either ingots, semifinished articles, (e.g. bar, strip, plate, rings, tubes) forging, or extrusion blanks, for finished articles which may require only machining.

U.K. Patent Specification No. 1379261 describes a method for manufacturing a shaped precision article from molten metal or molten metal alloy, comprising directing an atomized stream of molten metal or molten metal alloy onto a collecting surface to form a deposit, then directly working the deposit on the collecting surface by means of a die to form a precision metal or metal alloy article of a desired shape, and subsequently moving the precision shaped article from the collecting surface.

An improved method of producing coherent spray deposits is known from prior U.K. Patent Specification 1472939. In that specification metal particles are atomized by means of high velocity jets of gas and arrive at a collection surface in such a condition that welding to the already deposited metal is complete and all evidence of inter-particle boundaries is lost and a highly dense spray deposit is therefore produced. To achieve this high density, non-particulate microstructure within the deposit it is essential to control both the temperature distribution and "the state" (liquid, liquid/solid, solid) of the atomized particles on deposition and also the temperature and "state" of the surface of the already deposited metal. We found that in order to achieve a workable deposit that was substantially non-particulate in nature, free from macro-segregation, over 95% dense and which possessed a substantially uniformly distributed, closed-to-atmosphere internal pore structure it is essential that the atomizing gas extracts a critical amount of heat from the particles both during flight and on deposition.

Thus, one of the most important parameters influencing the properties of the sprayed deposit is the solidification rate of the atomized particles during flight, on and after deposition. An object of the present invention is to provide a method whereby higher rates of solidification can be achieved within the spray deposit.

Therefore, according to the present invention there is provided a method of producing a coherent product from liquid metal or metal alloy comprising the steps of atomizing a stream of molten metal or metal alloy to form a spray of hot metal atomized particles by subjecting the stream to relatively cold gas directed at the stream and providing additional cooling by applying to the stream or spray relatively cold solid particles. The applied particles may be of a different composition, either metallic or ceramic, preferably the same composition as the metal or metal alloy being sprayed resulting in a more rapidly solidified microstructures.

It will be understood that the invention may be used to produce any spray deposit shape, for example bars, strips, plates, discs, tubes or intricately shaped articles etc.

The invention also includes a spray deposit in which the rate of solidification has been accellerated by means of the cold applied particles being co-deposited with the atomized particles. The applied particles may be of different composition either metallic or ceramic or may be of the same composition to that of the metal or alloy being atomized.

In a preferred method of the invention the solid particles are suitably applied by generating a fluidized bed of the particulate material and transporting the material in a gas stream from the bed into the spray so that the applied particles are co-deposited with the atomized particles resulting in more rapid cooling after deposition. The rapid solidification achieved by the present invention means that an improved microstructure is attainable even compared with conventional spray deposition. Therefore, in accordance with a preferred aspect of the invention, there is provided a method of producing a rapidly solidified spray deposit from liquid metal or metal alloy comprising the steps of atomizing a stream of molten metal or metal alloy to form a spray of hot metal atomized particles by subjecting the stream of molten metal to relatively cold gas directed at the stream, injecting into the stream or spray solid particles at a temperature less than the superheat of the metal or metal alloy being atomized whereby a critical amount of heat is extracted from the metal or metal alloy atomized particles both in flight and on deposition by the atomizing gas and by the injected particles. In the method of the invention the extraction of heat from the atomized particles is effected by convection to the gas during flight and on deposition, and conduction to the solid injected particles particularly on deposition and after deposition to produce a spray deposit which is rapidly solidified. The extent of rapid solidification is dependent upon the temperature of the atomizing gas and the temperature and conductively of the solid injected particles. The injected particles may be the same as, or a different composition to, the atomized particles.

In particular the cooling may be seen as a three-stage process:

(i) in-flight cooling predominantly by convection to the atomizing gas (and the injected particle transportation gas, if used) but also a small amount by conduction to the solid injected particles by atomized particle to injected particle contact. Cooling will typically be in the range 103°–106° C./sec depending mainly on the atomized particle size. (Typically atomized particle sizes are in the range 1–300 microns).

(ii) on deposition, cooling by convection to the atomizing gas as it flows over the surface of the spray deposit and on deposition cooling by conduction to the relatively cold injected particles (which is extremely rapid) which are deposited into a thin semi-liquid semi-solid layer which forms on the surface on the spray-deposit.

(iii) after deposition cooling of the deposit by conduction to the cold injected particles.

However, it is essential to carefully control the heat extraction in each of the three above stages. It is also important to ensure that the surface of the already deposited metal consists of a layer of semi-solid/semi-liquid metal into which newly arriving atomized and injected particles are deposited. This is achieved by extracting heat from the atomized particles by supplying gas to the atomizing assembly under carefully controlled conditions of flow, pressure, temperature and gas to metal ratio and by controlling the temperature, size and quantity of the injected solid particles, with preheating if necessary and by controlling the further extraction of heat after deposition.

The conduction of heat on and after deposition to the injected particles is significant in providing much more rapid solidification than previously attainable which can greatly improve the microstructure of the sprayed deposit, particularly in terms of generating a finer grain size, a finer distribution of precipitates, second phases, and increased solid solubility.

In prior U.K. Patent No. 1472939 the rates of cooling in flight and on deposition were high due to the convected cooling by the atomizing gas. However, cooling after deposition was slow relying solely on heat conduction to the deposit. In this invention the cooling rate after deposit is considerably increased due to heat conduction to the cold injected particles present in the deposit.

The metal used may be any elemental metal or alloy that can be melted and atomized and examples include aluminium, aluminium base alloys, steels, nickel base alloys, cobalt, copper alloys and titanium base alloys.

The solid particulate material may be metallic or non metallic and may be in various physical forms (such as a powder or chopped wire for example) and sizes.

In the practice of the invention, the particulate solid material may be injected at any temperature or at temperatures less than the metal or alloy being sprayed and may be fed into the molten metal in a number of regions. It is, however, preferred to feed the material into so-called 'atomizing zone' either just before or immediately after the molten metal or metal alloy begins to break up into a spray. The atomizing gas could be an inert gas such argon nitrogen or helium normally at ambient temperature but always at a temperature less than the melting point of the metal or alloy being sprayed. If desired the solid particles may be injected with and carried by the atomizing gas, or carried by a separate flow of gas, or gravity fed or vibration fed into the atomizing zone.

With the present invention it is possible to form spray deposits which may be over 90% of theoretical density which are characterised, immediately after deposition, by a rapidly solidified microstructure consisting of a fine, uniform grain size, free of macro-segregation. The fact that injection and spraying is carried out in a purged and inert atmosphere means that there is little or no oxygen pick-up during spraying, injection and deposition, and no possibility of internal oxidation during further procesing due to the internal closed structure of any pores which may be present in the spray deposit.

Spray deposition, the invention of previous U.K. Patent No. 1472939, is dependent upon the rapid extraction of the superheat of the atomized metal and the majority of the latent heat of solidification from atomized particles in the spray to achieve a fine uniform macro-segregation free microstructure, as opposed to the pronounced macro-segregation and coarse microstructures often produced by conventional casting techniques. The present invention provides even more rapid cooling and therefore even finer microstructures. The extraction of heat is controlled to ensure the presence of residual liquid metal or alloy in a thin layer on the surface of the deposit which is then rapidly cooled by the injected particles.

The final deposited material may be in the form of a shaped article or a semi-finished product or ingot or may be worked to form an article of desired shape and/or consolidated by methods known in the art such as extrusion, forging, rolling, hot isostatic pressing, thixoworking etc.

The invention will now be described by way of example with reference to the accompanying drawings in which.

Figure 1:
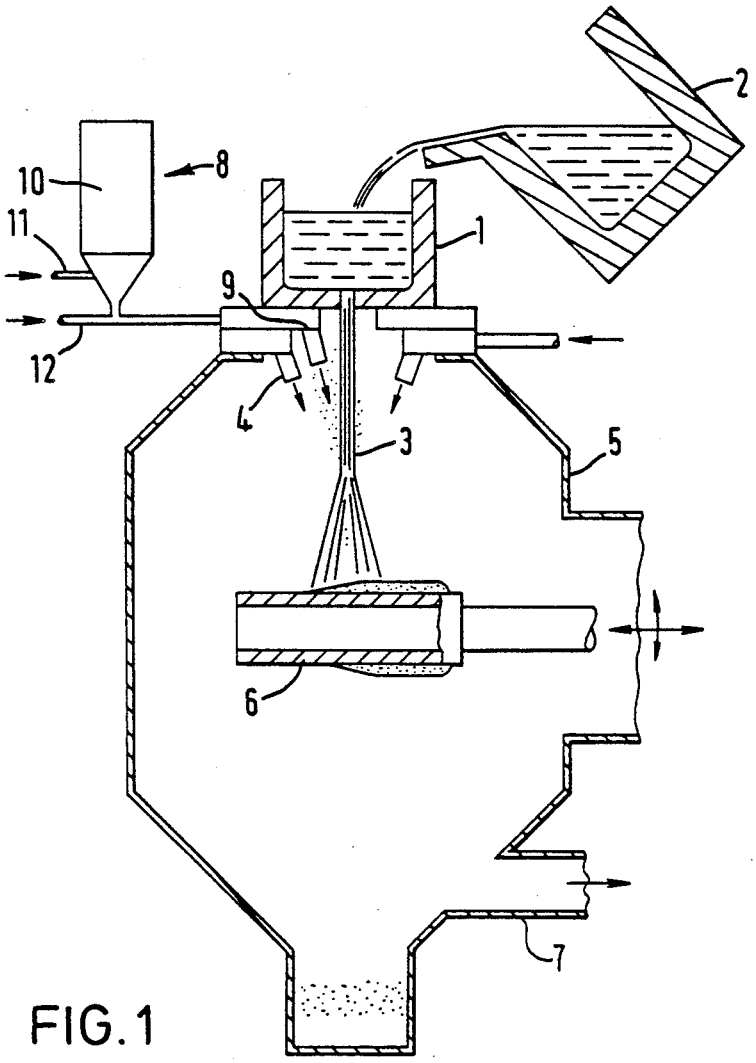
FIG. 1 is a diagrammatic view of a first embodiment of apparatus for carrying out the invention.

In FIG. 1 apparatus for the formation of metal or metal alloy deposits comprises a tundish 1 in which metal or metal alloy is held above its liquidus temperature. The tundish 1 receives the molten metal or metal alloy from a tiltable melting and dispensing furnace 2 and has a bottom opening so that the molten metal may issue in a stream 3 downwardly from the tundish 1 to be converted into a spray of atomized particles by atomizing gas jets 4 within a spray chamber 5; the spray chamber 5 first having been purged with inert gas so that the pick-up of oxygen is minimized. The atomized particles are deposited upon suitable collecting surface 6, in this case a mandrel to form a tubular deposit as will be explained.

The atomizing gas extracts a desired and critical amount of heat from the atomized particles in flight and on deposition upon the collecting surface 6 by supplying gas to the gas jets 4 with carefully controlled conditions of flow and pressure responsive to sensed variables such as changes in metal flow rate, metal head, temperature and spray distance (as the deposit increases in thickness).

In accordance with the invention, in order to make the solidification of the deposit more rapid, an injection unit 8 is provided which is arranged to inject metal or metal alloy or other particles at nozzle 9 into the stream 3 as it is atomized into a spray. As can be seen from FIG. 1 the injection unit 8 consists essentially of a particle dispensing container 10, an inlet 11 for introducing fluidizing gas into the container 10 to fluidize the particles held in the container, and a supply of transport gas 12. By injecting solid particles in the spray in this way, in addition to heat extraction by convection due to the atomizing gas removing heat to exhaust 7, a mixture of semi-solid atomized particles and injected particles which are cold relative to the sprayed particles is formed whereby additional cooling is achieved by conduction to the relatively cold particles by particle to particle contact during flight but in particular by conduction immediately on deposition and after deposition.

It is well known that fine powder materials are not free flowing and have a tendency to clog. Therefore, the well known technique of fluidizing is used in order for the powder material to be readily supplied to the injection nozzle 9. Thus the reservoir 10 is fluidized as shown in FIG. 1.

Using the above technique particles in any size range 300 micron to 1 micron (i.e. a similar size to the atomized particles) can be injected and co-deposited together with the atomized particles. For example, particles in the size range 50–100 microns could be injected or in the range 5–30 microns as required.

Figure 2:
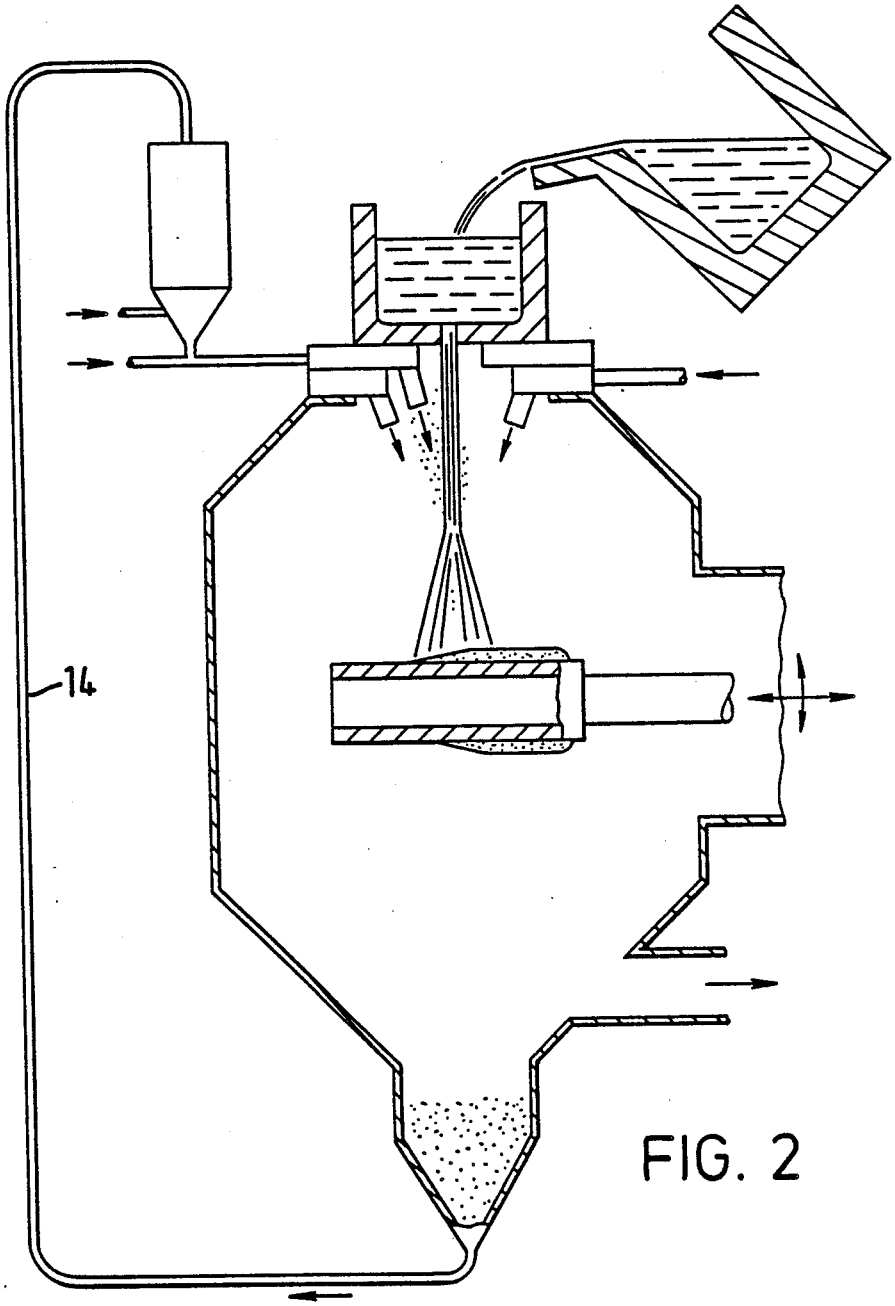
FIG. 2 is a diagrammatic view of a second embodiment of apparatus.

In FIG. 2, a modification to the apparatus of FIG. 1 is shown. In the formation of spray deposits it is never possible to concentrate all the atomized particles onto the collecting surface, there is always some overspray which ends up as powder at the bottom of the spray chamber. Normally, this overspray is collected and added to the next melt but, in accordance with the arrangement of FIG. 2, the overspray powder is collected and automatically recycled through conduit 14 back to the injection unit 8 thereby providing a source of powder for injection and rapid solidification. Alternatively the overspray powder may be collected in drums, sieved and then re-used. In the further alternative of FIG. 3 the overspray powder is carried in the exhausting gas and then separated by particle separator 15 and the particles transported back to the injection unit 8. In the cases where the overspray particles are recycled the composition of the injected particles are the same as the atomized particles.

Figure 3:
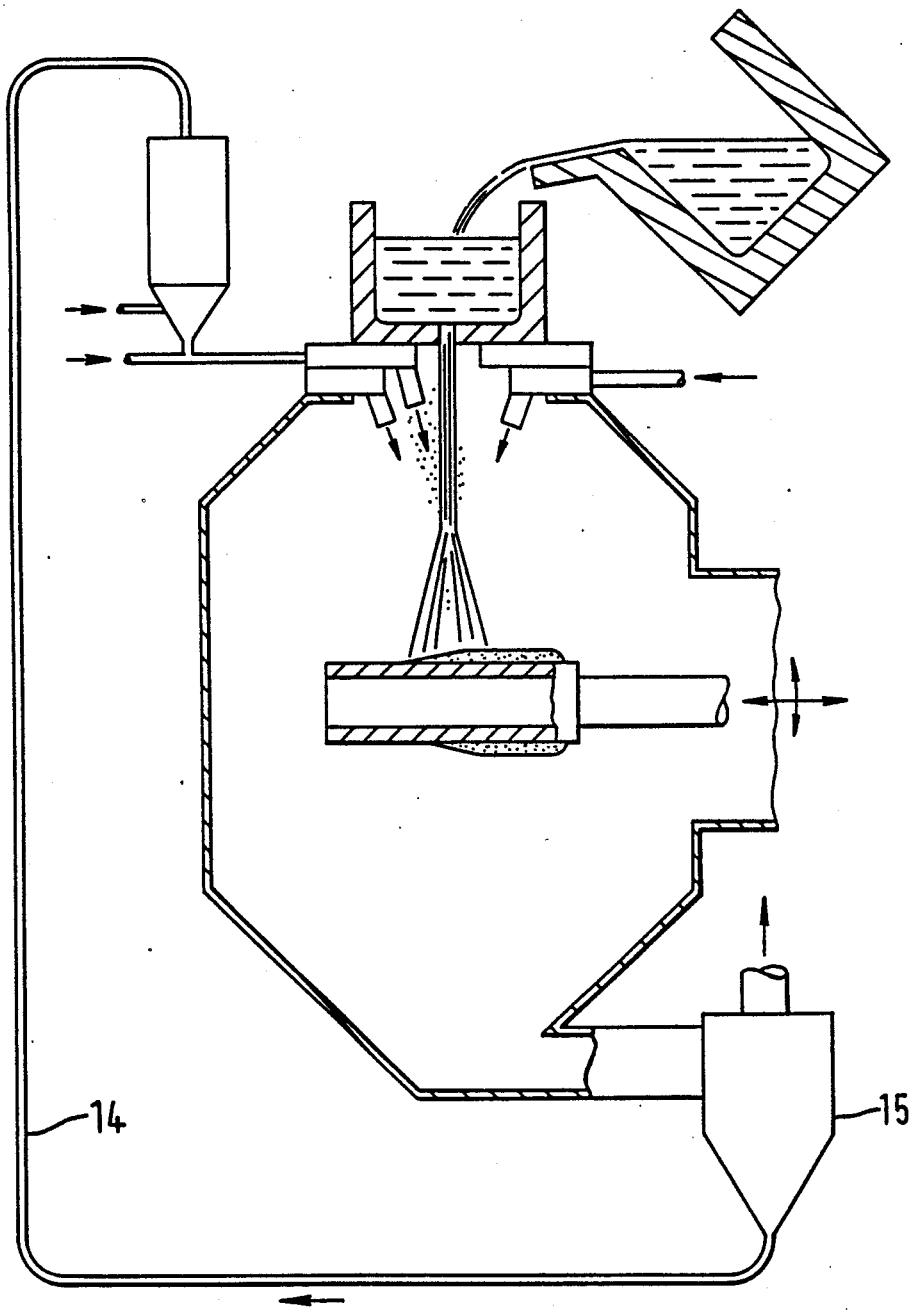
FIG. 3 is a diagrammatic view of a third embodiment of apparatus for carrying out the invention.

In FIGS. 1, 2 and 3, as indicated above, the spray is directed on to a rotating mandrel collecting surface 6 to form a tubular spray deposit, the collecting surface, during formation of the deposit being moved so as to effect a reciprocating movement in accordance with the arrows in the figures or a slow-traverse through the spray. Once formed, the tubular deposit is removed from the collecting surface. Subsequently, the tubular deposit can be further processed by cutting, machining, forging, extrusion, rolling, thixoworking or combinations of the process to produce tubes, rings or other components or semi-finished products. However, it will be understood that the invention may be used to produce any type of spray deposit, for example bar, strip, plate, discs or intricately shaped articles.

Figure 4:
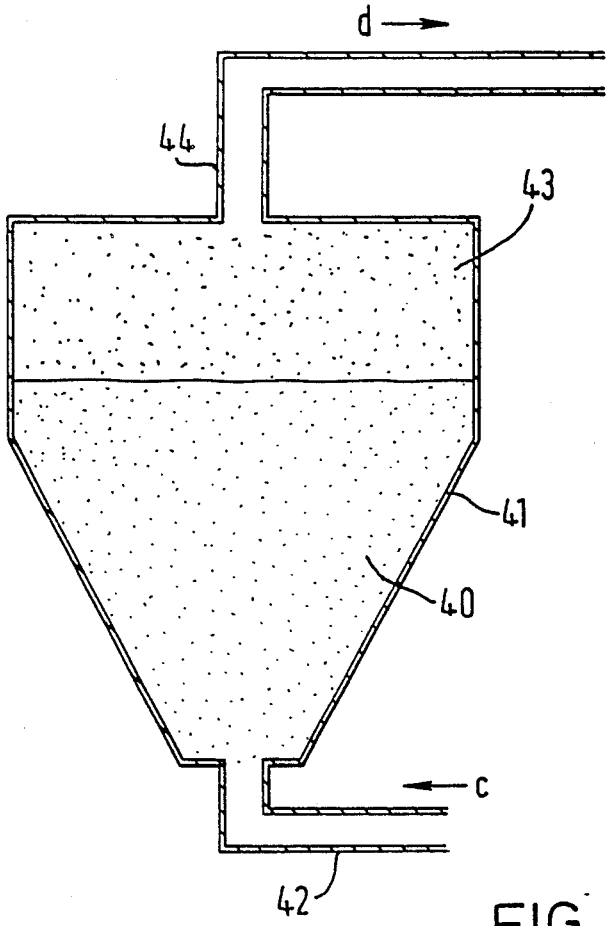
FIG. 4 is a diagrammatic view of an embodiment of fluidizing apparatus.

In FIG. 4, the particulate material is still applied by injection as discussed with reference to FIGS. 1 to 3 but the particulate material 40 in fluidizing chamber 41 is bubbled by the application of a carrier stream flowing in the direction of arrow c through conduit 42. The bubbling of the fine particulate material 40 causes the formation of a particulate atmosphere 43 within the top of the fluidizing chamber 41. The particules in this atmosphere are carried to the injection unit by the carrier stream exiting the chamber 41 in the direction of arrow d through conduit 44.

Thus, the present invention has the following important advantages:

(i) it increases the solidification rate of the spray deposit, particularly of the residual liquid metal remaining in the deposit after deposition. In the case of some metals or metal alloys which exhibit a large solidus/liquidus range, the rapid solidification in the case of a deposit is particularly advantageous since such metals and metal alloys are susceptible to the formation of small shrinkage and gas pores;

(ii) it can improve the metallurgical properties of the deposit; e.g. finer grain sizes leading to improved mechanical properties, hot workability etc; and (iii) it can increase material utilization in the case where the overspray material is recycled.

The invention is now illustrated by reference to the following examples:

EXAMPLE 1

Figure 5:
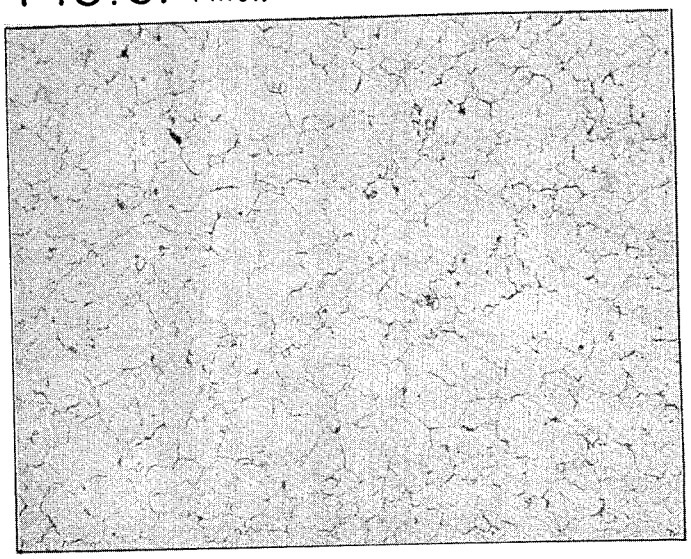
FIG. 5. PRIOR ART
FIG. 5 is a plate showing the microstructure of a deposit without the application of solid particles.

10 kg of a Stellite 6 cobalt-based hardfacing alloy was melted in an alumina crucible. When the alloy had reached a temperature of 80° C. above its liquidus temperature it was poured into a tundish located on top of a conventional spray-deposition unit. A stream of liquid metal emerged from the base of the tundish via a refractory nozzle into the spray-deposition unit. The metal was poured at a flow rate of approximately 25 kg per minute. The stream was atomized with high velocity jets of nitrogen gas to form a spray of metal droplets which were then directed at a tubular shaped collector where the droplets re-coalesced to form a tubular spray-deposit of 100 mm inside diameter × 30 mm wall thickness. The gas volume to metal ratio was 0.55 mm/kg. The spray deposit was then sectioned and the resulting microstructure at × 150 magnification is shown in FIG. 5. It can be seen that the grain size of the deposit is approximately 30–60 microns.

EXAMPLE 2

Figure 6:
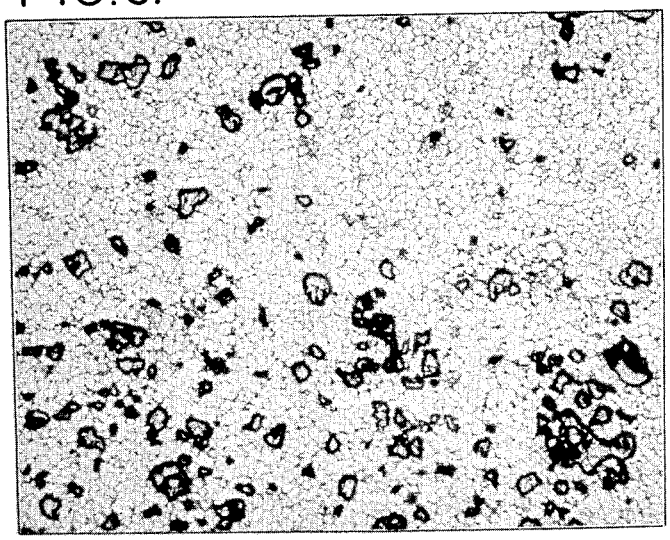
FIG. 6 is a plate showing the microstructure of a deposit with the application of solid particles in accordance with the invention.

A similar procedure to the above was adapted except that tungsten carbide particles of approximately 20 microns were introduced into the Stellite 6 alloy spray and co-deposited using the apparatus of FIG. 1. The resulting microstructure at × 150 magnification is shown in FIG. 6. It can be seen that a considerable refinement of the grains has occured resulting in a grain size of approximately 5–10 microns. This indicates a much more rapid cooling of the deposit.

We claim:

1. A method of increasing the solidification rate of a coherent spray deposited product produced from metal or metal alloy and thereby refining its microstructure comprising the steps of heating the metal or metal alloy above its liquidus temperature to form molten metal or metal alloy, atomizing a stream of the molten metal or metal alloy to form a spray of hot metal atomized droplets by subjecting the stream to relatively cold gas directed at the stream, introducing relatively cold solid particles into the spray of the molten metal or metal alloy, co-depositing the spray of solid particles and atomized droplets onto a collecting surface and, maintaining the surface of the already deposited metal or metal alloy in a semi-solid/semi-liquid state into which the solid particles and atomized droplets are co-deposited, the application of relatively cold solid particles increasing the solidification rate of the semi-solid/semi-liquid surface and thereby generating a fine uniform grain size which bears no direct relationship to the size of the atomized droplets.

2. A method of increasing the solidification rate of a coherent spray deposited product according to claim 1, wherein the solid particles are of the same composition as the metal or metal alloy being atomized.

3. A method of increasing the solidification rate of a coherent spray deposited product according to claim 1, wherein the solid particles are of a different composition, either metallic or non-metallic, from the metal or metal alloy being atomized.

4. A method of producing a coherent spray deposited product according to claim 1, wherein the solid particles are injected into the spray.

5. A method of increasing the solidification rate of a coherent spray deposited product according to claim 2, wherein overspray powder not collected as a part of the spray deposited product is recycled and used as a source for the solid particles.

6. A method of producing a coherent spray deposited product according to claim 1 wherein the solid particles are applied by generating a fluidized bed of the solid particles and transporting the solid particles in a gas stream from the bed to the spray.

7. A method of producing a rapidly solidified spray deposited product from metal or metal alloy comprising the steps of heating metal or metal alloy above its liquidus temperature to form molten metal or metal alloy, atomizing a stream of the molten metal or metal alloy to form a spray of hot metal atomized droplets by subjecting the stream of molten metal or metal alloy to relatively cold gas directed at the stream, injecting into the spray solid particles of the same composition as the metal or metal alloy being atomized, the solid particles being at a temperature less than the liquidus temperature of the metal or metal alloy being atomized, and, co-depositing the solid particles and the atomized droplets, the atomizing gas and injected solid particles extracting a critical amount of heat from the metal or metal alloy atomized particles both in flight and on deposition whereby the surface of the depositing metal or metal alloy is maintained in a semi-solid/semi-liquid state while the solidification rate thereof is increased to generate a fine uniform grain size in the deposit.

* * * * *